US005928037A

United States Patent [19]

Jetter et al.

[11] Patent Number: 5,928,037

[45] Date of Patent: Jul. 27, 1999

[54] COUPLED SECONDARY LOCKING MEMBER FOR AN ELECTRICAL CONNECTOR

[75] Inventors: Rolf Jetter; Andreas Wilkner, both of Darmstadt, Germany

[73] Assignee: The Whitaker Corporation, Wilmington, Del.

[21] Appl. No.: 09/043,538

[22] PCT Filed: Sep. 30, 1996

[86] PCT No.: PCT/IB96/01011

§ 371 Date: Mar. 23, 1998

§ 102(e) Date: Mar. 23, 1998

[87] PCT Pub. No.: WO97/13296

PCT Pub. Date: Apr. 10, 1997

[30] Foreign Application Priority Data

Oct. 4, 1995 [GB] United Kingdom ..... 9520518

[51] Int. Cl.[6] ..... H01R 13/434

[52] U.S. Cl. ..... 439/752

[58] Field of Search ..... 439/752, 595

[56] References Cited

U.S. PATENT DOCUMENTS 4,113,333 9/1978 Horowitz ..... 339/14 P
4,986,770 1/1991 Zinn et al. ..... 439/752
5,468,162 11/1995 Oda ..... 439/752
5,503,573 4/1996 Sagawa ..... 439/752
5,609,503 3/1997 Tsuji et al. ..... 439/752

FOREIGN PATENT DOCUMENTS 0 275 066-A1 7/1988 European Pat. Off. ..... H01R 13/436

*Primary Examiner*—Gary Paumen
*Attorney, Agent, or Firm*—Driscoll A. Nina

[57] ABSTRACT

An electrical connector comprising a connector housing (2) having a plurality of terminal receiving passageways (12, 14) therethrough for receiving terminals therein and a secondary lock member (26, 28) having a first position where the terminals can be received within the passageway (12, 14) and a second position where the terminals would be prevented from being withdrawn therefrom, the electrical connector being characterized in that the secondary lock member (26, 28) includes a first stage (26) operatively coupled to a second stage (28) and the first stage (26) has a stroke between the first and second positions that is greater than the stroke associated with the second stage (28).

10 Claims, 3 Drawing Sheets

COUPLED SECONDARY LOCKING MEMBER FOR AN ELECTRICAL CONNECTOR

BACKGROUND OF THE INVENTION

1. Field of the Invention

This invention relates to electrical connectors and in particular electrical connectors that utilize a secondary locking member to assure electrical terminals are retained in the connector housing.

2. Summary of the Prior Art

It is well known within the electrical connector industry to incorporate secondary locking members in order to assure that electrical terminals remain positively retained within a connector housing. Typically, the secondary locking members incorporate a shoulder that is movable into a terminal receiving passageway after the terminal has been placed therein so that it is not possible to move the terminal past a portion of the locking member. This is all very straight forward for electrical connectors that incorporate the same or similar sized contacts therein.

A problem exists particularly in hybrid connectors having multiple types of contacts therein where there is a significant disparity between the size of the contacts. One solution has been to locate the various sized contacts in particular regions within the connector and then use individual secondary locking members tailored to each of the particular regions. Another solution has been to provide a secondary locking member that has been compromised to provide some overlap into the passageway, but not full optimal shoulders for all of the various sized passageways. A problem with the first solution is that during assembly multiple secondary locking members must be actuated within the connector housing. This makes it very difficult to assure that all secondary locking members have been properly positioned. A problem with the second solution is that optimal secondary locking is not achieved. What is needed is a secondary locking system that overcomes the aforementioned problems.

These and other objects are accomplished by providing an electrical connector comprising a connector housing having a plurality of terminal receiving passageways therethrough for receiving terminals therein and a secondary lock member having a first position where the terminals can be received within the passageway and a second position where the terminals would be prevented from being withdrawn therefrom, the electrical connector being characterized in that the secondary lock member includes a first stage operatively coupled to a second stage and the first stage has a stroke between the first and second positions that is greater than the stroke associated with the second stage.

SUMMARY OF THE INVENTION

It is an advantage of this invention that a hybrid connector can accommodate terminals of different sizes requiring different secondary locking members with a secondary locking actuation that is directed to one of the stages as the first and second stage of the secondary locking member are operatively couples. In is another advantage of this invention that the device is simple to operate and optimum secondary locking may be achieved.

An alternative solution also accomplishes the foregoing objects by providing a single secondary locking member for a connector housing for receiving multiple contacts therein where at least two of the contacts are of different configuration, the secondary locking member comprising first and second locking shoulders for assuring retention of corresponding first and second differently configured contacts respectively where the secondary locking member has a first position where the first contacts may be inserted, a second position where the second contacts may be inserted and a third position where both the first and second contacts would be retained in the housing by the corresponding shoulders.

It is another advantage of the invention that the secondary locking member may be constructed so that in the second position a portion thereof at least partially locks the first contact in position, thereby assuring during the assembly process that the first contacts do not become dislodged. It is yet another advantage of this invention that a portion of the secondary locking member may block entrance of the second contact into the housing in the first position, thereby assuring proper assembly procedures are followed.

Figure 1:
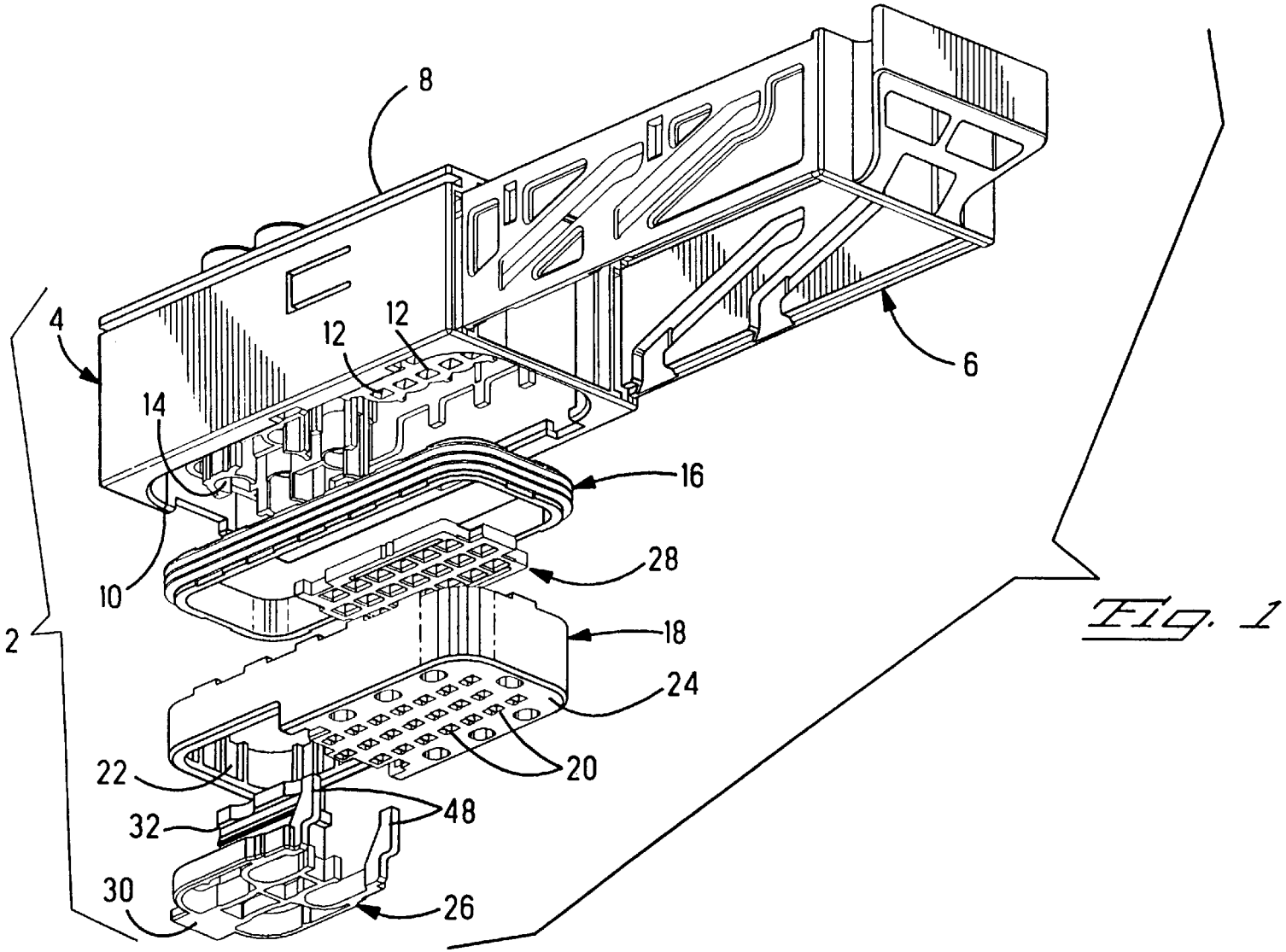
FIG. 1 is a lower exploded perspective view of an electrical connector according to the present invention incorporating a two-piece secondary locking member.

With reference first to FIG. 1, an electrical connector according to the present invention is shown generally at 2. The electrical connector 2 incorporates a main housing 4 that utilizes a camming slide 6 that is displaceable transversely to the direction of mating in order to effectuate connector mating. Connectors of this type are well known in the industry, and, as this feature is not required, will not be described in detail.

The connector housing 4 includes a wire receiving face 8 and a mating face 10. Extending therethrough are a plurality of housing portions of terminal receiving passageways 12 constructed to receive a first terminal (not shown) therein. The housing 4 also includes larger terminal receiving passageways 14 for receiving a second larger terminal therein. Examples of the types of terminals that could be positioned in a connector housing 4 as shown are the AMP Incorporated 2.5 mm round contact system which would be received in terminal receiving passageways 14 and AMP Incorporated's Micro Quadlok System Contacts that could be receivable in the smaller passageways 12.

The connector 2 further includes a seal member 16 that is received within the housing 4 such that when a shroud of a mating connector (not shown) is inserted into the mating side 10 and the connectors are drawn together, a contaminant-tight connection is formed. This construction is also well known. The electrical connector 2 further includes a nose portion 18 that is fitted to the main housing 4 in order to fully define the terminal receiving passageways. In this embodiment, the nose portion 18 includes those portion terminal receiving passageways 20 that correspond to housing portion terminal receiving passageways 12. The nose portion 18 further includes an open cutout 22 wherein a portion of a face 24 thereof has been cut away.

The electrical connector 2 incorporates a secondary locking member that includes a first stage 26 and an second stage 28. The second stage 28 is sandwiched between the main housing 4 and the nose portion 18 while the first stage 26 is seated within the cutout 22 of the nose 18. The first stage 26 includes a face portion 30 constructed to be generally co-planar with the face 24 of the nose portion 18 and a secondary locking pedestal 32 extending therefrom to approach the portion of the housing 4 through which the larger terminal receiving passageways 14 are exposed. The second stage 28 is a plate member as is well known in secondary locking applications.

Figure 2:
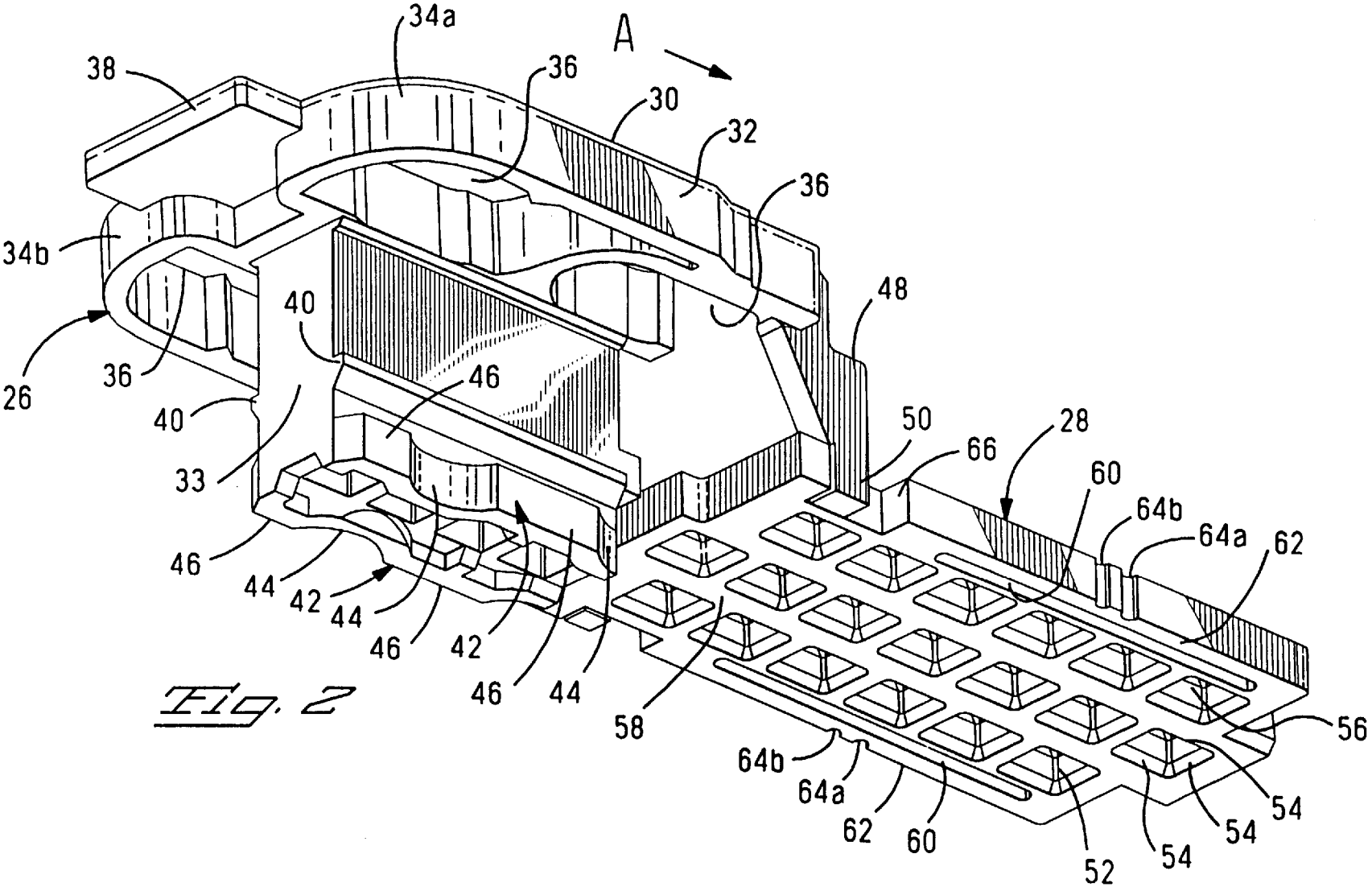
FIG. 2 is an upper perspective view of the secondary locking member according to the present invention that is incorporated into the connector of FIG. 1.

With reference now also to FIG. 2, the secondary locking member 26,28 will be more fully described. With reference first to the first stage 26 of the secondary locking member, the first stage 26 includes the mating face 30 that, as described with respect to FIG. 1, would be approximately co-planar with the face 24 of the nose portion 18. The face portion 30 is part of a general plate 32 that comprises overhanging portions 34*a*,34*b* that extend outward from pedestal 33 to form a T-shaped structure. Mating terminal receiving openings 36 extend through the plate portions 34*a*,34*b* such that a mating terminal may pass therethrough in order to form an interconnection with the terminal (not shown) carried in the connector 2. Further incorporated into the plate 32 is an actuation tab 38 that is used for moving the secondary lock member.

The pedestal 33 of the first stage 26 hangs from the plate 32 in a T-like manner between the openings 36. The pedestal 33 carries a pair of positioning ribs 40 constructed to co-operate with a corresponding feature of the connector housing 4 to assure that the first stage 26 remains properly positioned. At the end of the pedestal 33 are a pair of locking ribs 42 extending outward therefrom. The locking ribs 42 each include scalloped portions 44 that would be aligned with the corresponding larger passageways 14 in a first position so that the terminals could be inserted or removed therefrom and locking shoulders 46 that would overhang a portion of the passageway 14 when the secondary locking member 26 is at a second position such that the terminal therein is prevented from being withdrawn. In an extreme example, it could be imagined that the first stage 26 would have to move from a position where the scalloped portion 44 is concentric with the housing terminal passageway 14 to a position where the locking shoulder 46 fully spans the passageway 14. With larger terminals, this could be a significant displacement. Further depending from the plate 32 are a pair of coupling arms 48 that include an engaging section 50. These coupling arms 48 are for operatively coupling the first stage 26 to the second stage 28 as will be described below.

The second stage 28 includes a plurality of openings 52 that are constructed to correspond to the smaller terminal receiving passageways 12 in the housing 4. Each opening 52 includes guiding chamfers 54 on three sides thereof and one unbroken edge 56 that acts as the secondary locking shoulder that is brought across a portion of the terminal receiving passageway 12 in order to prevent a terminal from being displaced therefrom. The second stage 28 is made up of a main body 58 through which the passageways 52 extend. A pair of slots 60 along the edges of the main body 58 define resilient straps 62. The straps 62 have first and second notches 64*a*,64*b* therein that define a first position where the terminals (not shown) may be received into the smaller passageways 12 and a second position where the shoulder 56 overhangs a portion of the passageway 12 to prevent withdrawal of the terminals. Further included in the plate 58 are a pair of coupling notches 66 that are formed as U-shaped openings in the sides of the plate 58.

The first stage 26 and the second stage 28 are operatively coupled together by extending the actuating portion 50 of the actuating legs 48 into the notches 66. As may be seen in FIG. 2, the length of the notch 66 is greater than the width of the actuating portion 50 of the leg 48. This assures that when the first stage 26 is displaced in the direction of arrow A, the first stage travels the length of the notch 66 before abutting one of the sides of the U-shaped notch 66 and thereby "picking up" the second stage 28 which is then moved in conjunction with the first stage. In this embodiment, the first stage 26 moves the amount that the notch 66 is greater than the actuating portion 50 plus the distance between the first and second notches 64*a*,64*b*, while the second stage moves only the distance between the first and second notches 64*a*,64*b*. The structure also operates in reverse. In addition, the coupled stages 26,28 may interact such that an intermediate position is established. This intermediate position could be established when the first stage 26 is moved initially the distance of the notches 66. At this position, a portion of the first stage 26 would be moved over a portion of the corresponding passageway 12, thereby assuring the contacts positioned therein do not become dislodged during handling and further assembly.

Figure 3:
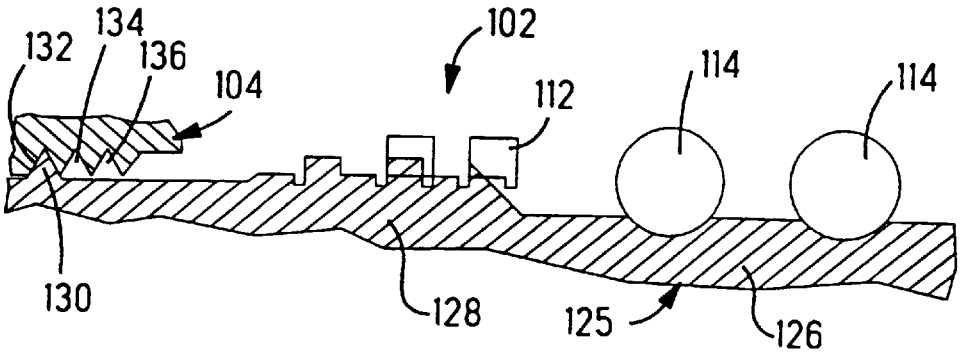
FIG. 3 is a partially cut-away representational view of an electrical connector showing a representation of a single piece secondary locking member according to the present invention in a first position.
Figure 4:
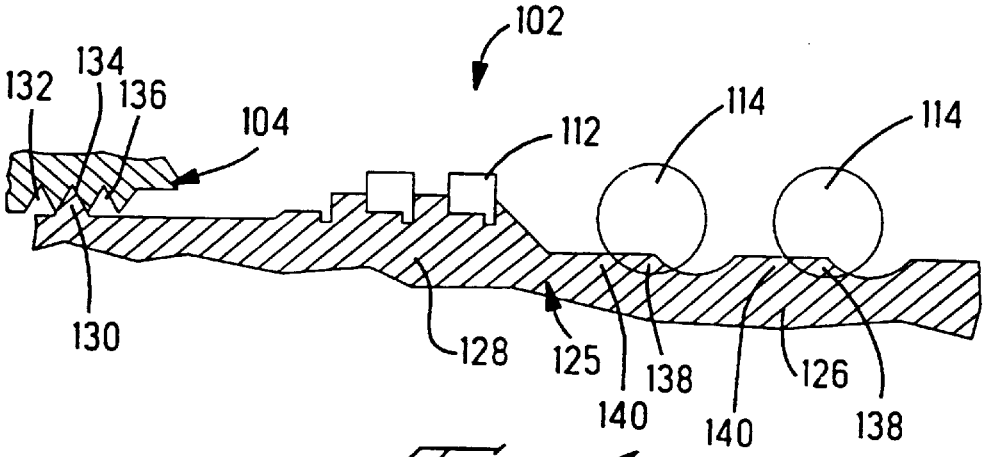
FIG. 4 is a partially cut-away representational view similar to FIG. 3 showing the secondary locking member in a second position.
Figure 5:
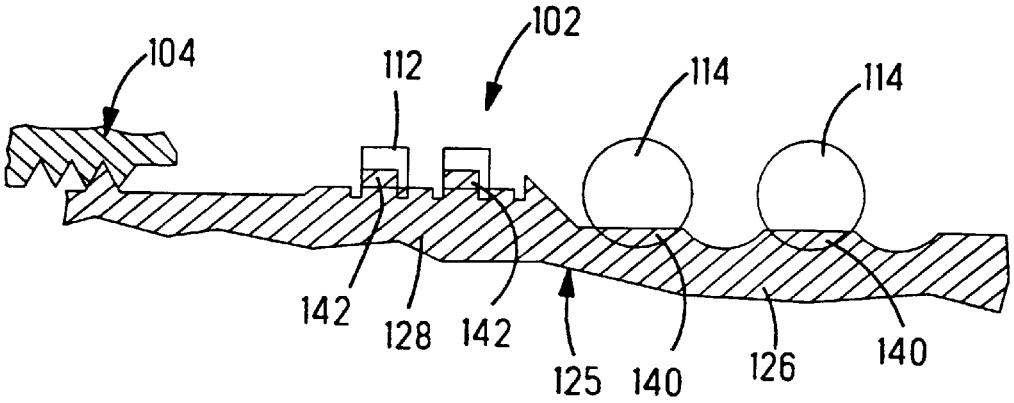
FIG. 5 is a partially cut-away representational view similar to FIG. 3 showing the secondary locking member in a third position.

A single piece secondary locking member embodiment of the present invention will now be described with reference to FIGS. 3–5. A portion of an electrical connector as was generally described above is representationally shown generally at 102. The connector 102 includes a housing 104 with first terminal receiving passageways 112 and second terminal receiving passageways 114 therethrough for receiving different terminals (not shown) therein. The connector 102 also includes a secondary locking member 125 having a first portion 126 and a second portion 128 that correspond respectively to the first and second passageways 112,114. In this embodiment, the secondary locking member 125 is of one piece construction.

The secondary lock 125 and the operation thereof will now be described in detail. FIG. 3 represents a first position where contacts may be inserted into one of the passageways 114. The first position is established by incorporating a resilient latch arm 130 into the secondary lock 125 that cooperates with the first 132 of a series of three catches 132,134,136 in the connector housing 104. Furthermore, advantageously in this embodiment the secondary lock 125 is constructed to at least partially block the other passageways 112 in he first position, thereby assuring proper assembly procedures are followed. Once the terminals have been placed in their respective passageway 114, the secondary lock 125 is displaced to the second or intermediate position shown in FIG. 4. In the intermediate position, the secondary lock 125 is positioned so that a portion 138 of a first locking shoulder 140 blocks a portion of the first passageways 114 such that any terminals set therein would be retained while the second passageways 112 are unobstructed, thereby enabling terminals to be seated therein. In this position, the latch arm 130 is now disposed in the second 134 of the series of catches 132,134,136. Finally, with all terminals in place, the secondary lock 125 is displaced into its final locked position, shown in FIG. 5, where the latch arm 130 is received in the third 134 of the series of catches 132,134, 136. In this position, a second shoulder 142 at least partially obstructs the second passageway 112 thereby retaining any terminal therein. Furthermore, as seen in FIG. 3, the portion of the secondary locking member 125 used to initially block the passageway 112 may either be formed as an additional protrusion or advantageously be the secondary locking member 125 for the adjacent passageway.

Advantageously then an electrical connector is provided having a secondary locking member that is comprised of first and second stages that are operatively coupled so that the displacement of each stage may differ with the corresponding stage. While the connector has been disclosed with respect to the particular embodiment described above, it is imagined that various methods of coupling between the two stages may be realized and it would also be possible to incorporate this multi-stage coupling into a circular connector. Furthermore, while only two stages have been described it is envisioned that more stages may be developed as required. Finally, although described with respect to hybrid connectors, it may be desirable to incorporate the present invention into a connector having only one style of contacts but where it is desirable to load the contacts in multiple stages and lock the stages in place while still providing for insertion of the other stages.

We claim:

1. An electrical connector for positioning a plurality of terminals, the electrical connector comprising a connector housing having a plurality of terminal receiving passageways therethrough for receiving corresponding terminals, the plurality of terminal receiving passageways including a first set of the passageways and a second set of the passageways where each set of the passageways includes at least one passageway, and a locking member for positively retaining terminals in respective passageways, the locking member having a first stage associated with the first set of the passageways and a second stage associated with the second set of passageways, the first stage cooperates with the second stage to effect displacement thereof, where the locking member is positionable in an initial position where terminals associated with the first stage of the locking member can be loaded into the connector housing and a final position where all of the terminals inserted into the first and second sets of passageways are positively retained therein by the associated first stage or second stage of the locking member; the electrical connector housing being characterized in that the locking member has an intermediate position where the first stage has been displaced from the initial position to positively retain terminals in the first set of the passageways in the connector housing and, in this intermediate position, terminals associated with the second stage can be loaded in corresponding passageways.

2. The electrical connector of claim 1, wherein the second stage that is operatively coupled to the first stage is distinct therefrom to provide that the second stage is independently moveable with respect to the first stage.

3. The electrical connector of claim 2, wherein in moving the locking member from the initial position to the final position, the first stage undergoes a displacement greater than the displacement of the second stage.

4. The electrical connector of claim 1, wherein the locking member is displaceable transversely to the passageways and the first and second stages include shoulders corresponding to respective passageways where the shoulders partially block the respective passageways to retain the terminals therein.

5. The electrical connector of claim 1, wherein the first and second stages are coupled together in such a way that reverse displacement, from the final position to the initial position is possible by displacing the first stage.

6. The electrical connector of claim 2, wherein the first stage includes a coupling arm having an engaging section that is received in a notch in the second stage where the length of the notch is greater than the width of the engaging section to permit relative displacement therebetween.

7. The electrical connector of claim 1, wherein the connector housing includes multiple passageways corresponding to the first stage and multiple passageways associated with the second stage and at least some of the passageways associated with the first stage are configured for receiving a different type of terminal than at least some of the passageways associated with the second stage.

8. The electrical connector of claim 1, wherein the secondary locking member includes position defining features for maintaining in a positive manner, each of the stages in their respective positions corresponding to the initial, intermediate, and final positions.

9. The electrical connector of claim 1, wherein position defining features are included on the second stage to establish the position of the second stage when the secondary locking member is in the intermediate and final positions.

10. The electrical connector of claim 2, wherein the first stage includes a manipulating tab for effecting displacement thereof.

* * * * *